United States Patent [19]

Blazek

[11] 4,195,683

[45] Apr. 1, 1980

[54] METHOD OF FORMING METAL ARTICLE HAVING PLURALITY OF AIRFOILS EXTENDING OUTWARDLY FROM A HUB

[75] Inventor: William S. Blazek, Valley City, Ohio

[73] Assignee: TRW Inc., Cleveland, Ohio

[21] Appl. No.: 860,581

[22] Filed: Dec. 14, 1977

[51] Int. Cl.[2] ..... B22C 9/04; B22D 19/04

[52] U.S. Cl. ..... 164/10; 164/25; 164/26; 164/35; 164/108

[58] Field of Search ..... 164/9, 10, 26, 35, 108, 164/25

[56] References Cited

U.S. PATENT DOCUMENTS

| | | | |
|---|---|---|---|
| 1,005,736 | 10/1911 | Wilkinson | 164/11 |
| 2,420,851 | 5/1947 | Zahn et al. | 164/35 |
| 2,756,475 | 7/1956 | Hanink et al. | 164/30 |
| 2,765,508 | 10/1956 | Spitler | 164/10 |
| 3,063,113 | 11/1962 | Operhall et al. | 164/45 |
| 3,204,303 | 9/1965 | Chandley | 164/35 X |
| 3,279,006 | 10/1966 | Schwartz et al. | 164/35 X |
| 3,669,177 | 6/1972 | Ingalls et al. | 164/26 |
| 3,731,726 | 5/1973 | Eberle | 164/9 |
| 3,996,991 | 12/1976 | Ugata et al. | 164/35 |
| 4,008,052 | 2/1977 | Vishnevsky et al. | 164/75 X |

FOREIGN PATENT DOCUMENTS

| | | |
|---|---|---|
| 238005 | 6/1945 | Switzerland . |
| 1180145 | 2/1970 | United Kingdom . |

*Primary Examiner*—Robert Louis Spruill
*Assistant Examiner*—J. Reed Batten, Jr.

[57] ABSTRACT

The present invention provides an improved method of forming a metal article having a plurality of airfoils which extend outwardly from a hub. The metal airfoils are formed separately from the hub. In forming a mold to cast the article, blade portions of the metal airfoils are coated with wax. The metal airfoils are then placed in a circular array and are covered with a coating of liquid ceramic mold material. This wet coating of ceramic mold material is dried to form an annular mold wall section having a plurality of recesses in which the blades of the metal airfoils are disposed. The wax coating over the metal airfoil blades is subsequently removed from the recesses to provide space between the blades and the side walls of the recesses. The annular mold wall section in which the blade containing recesses are formed is then connected with top and bottom mold sections to further define a mold cavity having a configuration corresponding to the hub portion of the article. Before casting, the mold is preheated to a relatively high temperature with the blade portions of the airfoils in their associated recesses. As the mold is preheated, the metal airfoils expand to completely fill the recesses in which the blade portions of the airfoils are disposed. Molten metal is then poured into the mold cavity and cooled to form a hub which interconnects the roots of the airfoils.

12 Claims, 6 Drawing Figures

FIG. 1
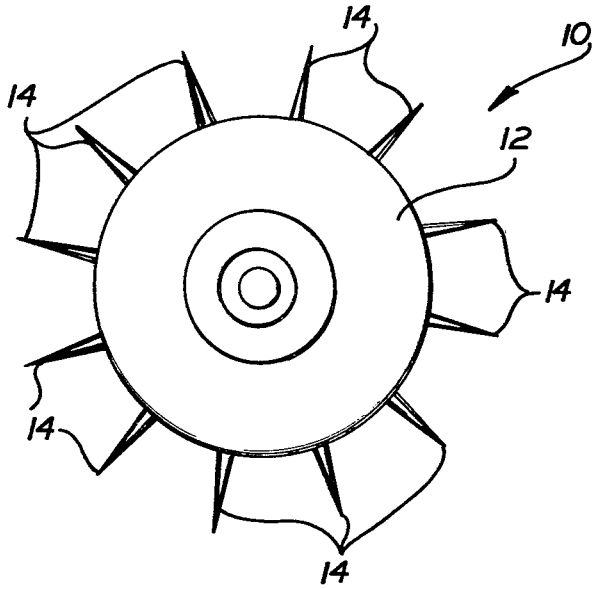
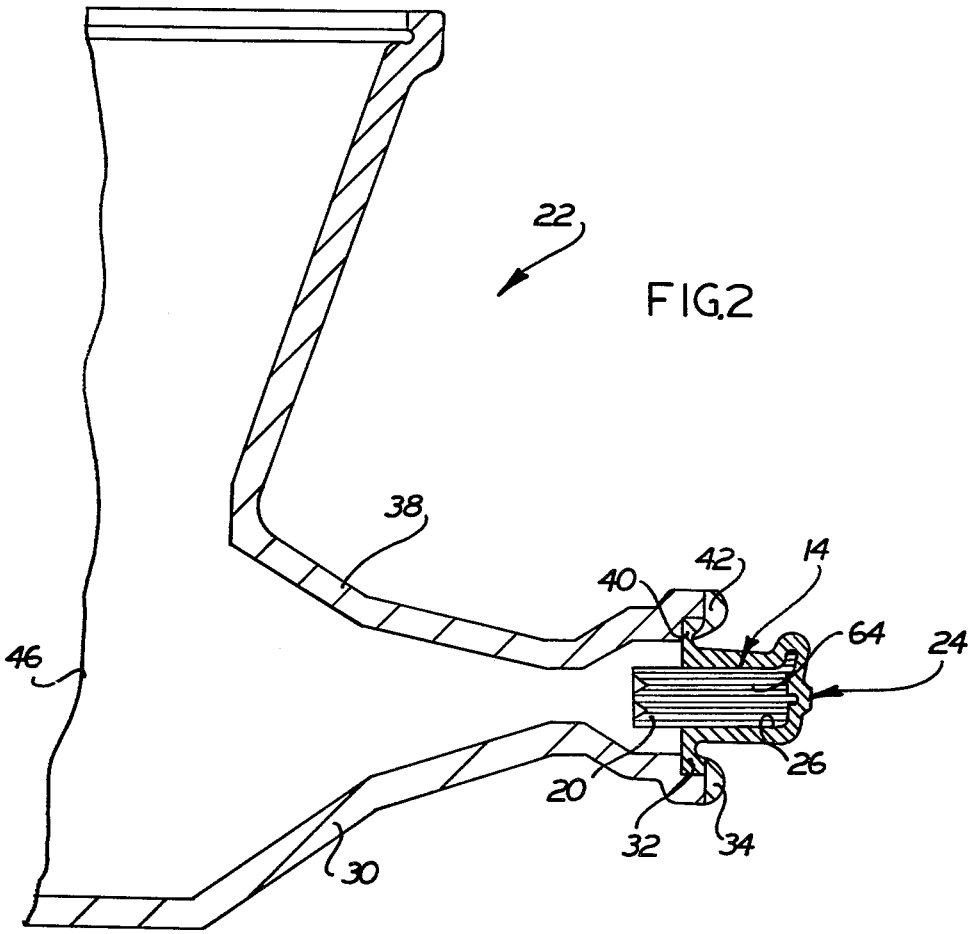
FIG. 2

METHOD OF FORMING METAL ARTICLE HAVING PLURALITY OF AIRFOILS EXTENDING OUTWARDLY FROM A HUB

BACKGROUND OF THE INVENTION

This invention relates generally to a method of forming a metal article having an airfoil and more specifically to a metal article having a performed airfoil which is connected with a hub or base.

Turbine engine components having airfoils extending outwardly from a hub have previously been formed by making a wax pattern with a configuration corresponding to the shape of the airfoils. This wax pattern is covered with a wet coating of liquid ceramic mold material. After the ceramic mold material has dried, the wax pattern is removed to provide a mold cavity having a configuration corresponding to the configuration of the pattern. Molten metal is then poured into the mold cavity to form the hub and airfoils. This known method of forming turbine engine components is disclosed in U.S. Pat. No. 3,669,177.

When turbine engine components are formed in the manner set forth above, the airfoils and the hub are integrally cast of the same metal at the same time. In order to obtain the advantages which can result from forming the airfoils separately from the hub, bimetallic casting processes have been suggested. In these bimetallic casting processes, a metal preform is positioned in a mold cavity into which molten metal is subsequently poured. A known bimetallic casting process is disclosed in U.S. Pat. No. 4,008,052. This known process requires the forming of the mold separately from the airfoil or other preform.

A method of forming a turbine wheel is disclosed in U.S. Pat. No. 1,005,736. In the casting method disclosed in this patent, a plurality of buckets or vanes are disposed in a circular array in a sand mold. The sand is packed around the vanes and baked in an oven. A sand cope and drag having a configuration corresponding to the hub of the turbine wheel is then connected with the baked core. It should be noted that this patent utilizes a relatively difficult sand casting process and does not lend itself to being used with ceramic molds.

One of the problems which has been encountered in forming a bicast product with a ceramic mold is that the coefficient of thermal expansion for the ceramic mold material is substantially different than the coefficient of thermal expansion for the metal preform. Therefore, if a ceramic mold is formed around a metal preform in a manner similar to that in which sand is packed around the metal preform in U.S. Pat. No. 1,005,736, the relatively high rate of thermal expansion of the metal preform will result in damage to the mold when the mold and the preform are preheated prior to casting of a product.

SUMMARY OF THE PRESENT INVENTION

The present invention provides a method of forming a metal article having one or more airfoils which are connected with a base or hub. When the method is to be used to cast an article having a plurality of airfoils extending outwardly from a hub, blade portions of separate metal airfoils are covered with a thin coating of wax. The airfoils are then arranged in a circle and are covered with a wet coating of ceramic mold material. The ceramic mold material dries to form an annular mold wall section having recesses with configurations corresponding to the configurations of the airfoils. The wax coating is then removed from the recesses by firing the ceramic mold material. When they cool, this results in the formation of space between the airfoils and the side walls of mold recesses in which the airfoils are disposed. The mold assembly is then completed by connecting top and bottom mold wall sections with the annular mold wall section containing the airfoils.

Prior to pouring of molten metal into the mold assembly, the mold assembly is preheated to a relatively high temperature. As the mold assembly and the metal airfoils are heated, the airfoils expand to a greater extent than the ceramic mold material overlying the airfoils. Due to their higher coefficient of expansion, the metal airfoils completely fill the recesses in which they are disposed when the mold assembly has been preheated prior to casting. Although the present invention is advantageously used to cast an article having a plurality of airfoils extending outwardly from a hub, it is contemplated that features of the invention will be used in making other types of articles.

Accordingly, it is an object of this invention to provide a new and improved method of forming a metal article having a plurality of airfoils extending outwardly from a hub and wherein the method includes the step of covering a circular array of metal airfoils with a wet coating of liquid ceramic mold material, drying this wet coating of ceramic mold material to form a mold wall having a circular array of recesses in which the metal airfoils are disposed, and pouring molten metal into a mold cavity to form a hub interconnecting the circular array of metal airfoils.

Another object of this invention is to provide a new and improved method of forming a metal article, the method includes the steps of providing a metal airfoil, at least partially covering the metal airfoil with a coating of wax, at least partially covering the coating of wax with a wet coating of ceramic mold material, drying the wet coating of ceramic mold material to define a recess with a configuration corresponding to the configuration of the metal airfoil, providing space in the recess containing the metal airfoil by removing the wax from the recess, effecting thermal expansion of the airfoil into the space in the recess by heating the airfoil and pouring molten metal into a mold cavity with the thermally expanded airfoil in the recess.

BRIEF DESCRIPTION OF THE DRAWINGS

The foregoing and other objects and features of the present invention will become more apparent upon a consideration of the following description taken in connection with the accompanying drawings wherein:

FIG. 1 is a somewhat schematicized drawing of a turbine engine component having a plurality of airfoils extending outwardly from a hub;

FIG. 2 is a fragmentary sectional view of a portion of a mold assembly in which the turbine engine component of FIG. 1 is cast;

DESCRIPTION OF ONE SPECIFIC PREFERRED EMBODIMENT OF THE INVENTION

A turbine engine component 10 (FIG. 1) includes a generally circular hub 12 and a plurality of radially outwardly extending airfoils 14. The airfoils 14 and hub are advantageously formed of different metals. Thus in one specific instance the airfoils were NiTaC-13 while the hub 12 was IN-792 metal. In addition, the turbine blades were advantageously formed by an electrochemical machining process and were electropolished. Of course, the hub and blades could be formed with different metals if desired and could be formed in different ways, for example the airfoils 14 could be formed by a directional solidification casting process if desired.

Figure 3:
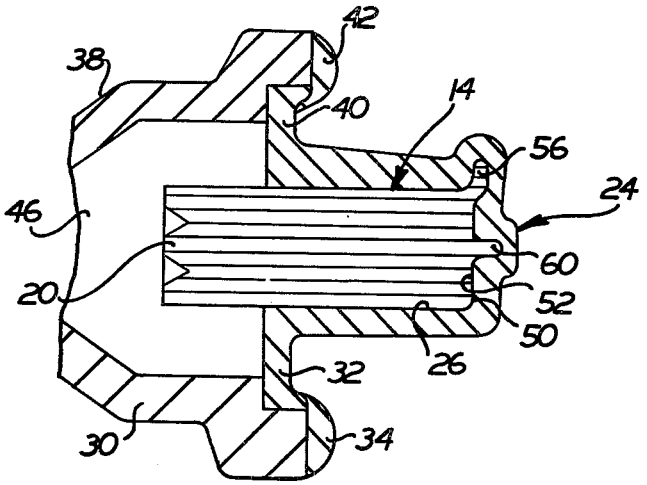
FIG. 3 is an enlarged fragmentary sectional view of a portion of the mold assembly of FIG. 2 and depicting the relationship between a metal airfoil and a recess in which a blade portion of the metal airfoil is disposed.

In forming the turbine engine component 10, the hub 12 is advantageously cast around root end portions 20 (see FIGS. 2 and 3) of the airfoils 14 using a mold assembly 22 (see FIG. 2). The mold assembly 22 includes a ceramic, annular wall section 24 in which there are a plurality of recesses 26 arranged in a circular array. A preformed metal airfoil 14 is disposed in each of the recesses 26 in the wall section 24.

In order to provide a generally circular mold cavity in which the hub 12 of the turbine engine component 10 is cast around the root 20 of the airfoils 14, the mold assembly 22 includes a circular bottom wall section 30 which is connected with a circular flange 32 of the mold wall section 24 by a suitable cement 34. In addition, a riser or top mold section 38 is connected with an upper flange 40 of the mold wall section 24 by a circular body of cement 42. The upper and lower mold sections 38 and 30 cooperate with the mold wall section 24 to form a mold cavity 46 into which the root end portions of a plurality of the metal airfoils 14 extend. Molten metal is poured into the mold cavity 46 to fill the cavity and interconnect the root end portions of the airfoils 14.

The metal airfoils 14 have a higher rate of thermal expansion than the ceramic mold material forming the wall section 24. To accommodate expansion of the metal airfoils 14, there is space between the airfoils 14 and surfaces of the recesses 26 in which the airfoils are disposed when the mold wall section 24 and airfoils are at room temperature. As the mold wall section 24 and the airfoils 14 are preheated to approximately 1800°-1900° F. before casting, the airfoils expand to completely fill the recesses 26 in the manner shown in FIG. 3. In the absence of the expansion space for each of the airfoils 14, the stress applied by the thermal expansion of the airfoils could result in breakage of the relatively brittle ceramic mold material from which the wall section 24 is formed. The space between each of the airfoils 14 and the side walls of the recesses 26 at room temperature is of such a size as to enable the airfoils to thermally expand into tight abutting engagement with the surfaces of the recesses 26 to completely fill the recesses in the manner shown in FIG. 3 when both the airfoil 14 and mold wall section 24 have been preheated.

It is contemplated that the mold wall section 24 will be moved about when both the airfoil 14 and the mold wall section are at room temperature. During this handling of the mold wall section 24, it is desirable to maintain each of the airfoils 14 in their associated recesses 26. In addition, it is desirable to have the loose airfoils 14 positioned in their recesses 26 in such a manner that when the mold wall section 24 and airfoils are preheated, each of the airfoils will be in a predetermined orientation relative to its associated recess with a tip end portion 50 of the airfoil 14 abutting an end surface 52 of the recess 26.

In order to hold the airfoils 14 in the recesses 26 and to properly orient the airfoils relative to the recesses when both the airfoils 14 and mold wall section 24 are at room temperature, the identical airfoils are each provided with a plurality of projections which engage the mold wall section 24 to hold the airfoils in place. Thus, each airfoil 14 has an upwardly (as viewed in FIG. 3) extending hook or projection 56 which extends into a similarly shaped portion of the recess 26. The projection 56 holds the airfoil against moving radially inwardly (that is toward the left as viewed in FIG. 3) when the loose airfoil 14 and mold wall section 24 are at room temperature. Similarly, a radially extending projection or nose 60 formed on the tip end 50 of the airfoil 14 extends into a similarly shaped projection of the recess 26 to position the airfoil vertically (as viewed in FIG. 3) in the recess. Due to engagement of the projections 56 and 60 on the airfoil 14 with the mold wall section 24, the loose airfoil 14 is held in the recess 26 in a position such that heating of the airfoil results in thermal expansion of the airfoil to fill the recess 26 in the manner shown in FIG. 3.

In accordance with a feature of the invention, the identical metal airfoils 14 are used as a part of a pattern during the formation of the ceramic mold wall section 24. In order to use the airfoils 14 as patterns, the root end portions 20 of the airfoils are first covered with wax in the manner illustrated in FIG. 4. Blade portions 64 of the airfoils are then dipped into hot wax to form a thin coating over the blades of the airfoils.

Figure 6:
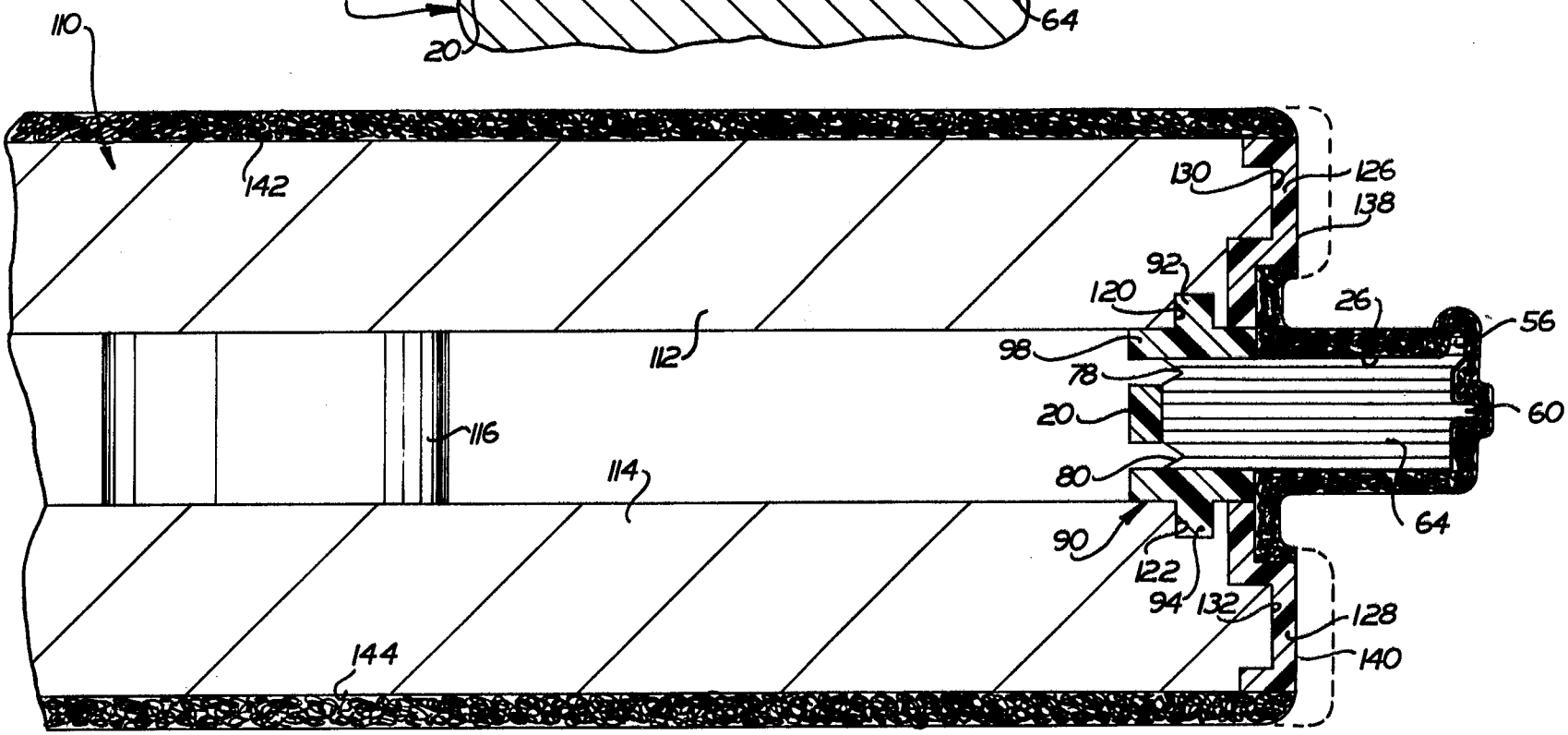
FIG. 6 is a fragmentary sectional view illustrating the manner in which the wax covered root of the airfoil is held as the airfoil is covered with a wet coating of ceramic mold material.

The wax coated airfoils 14 are then held in a circular array in a dipping fixture in the manner shown in FIG. 6 while the airfoils are dipped in liquid ceramic mold material. The resulting wet coating of ceramic mold material overlying the airfoils is dried. The wax coating over the blades 64 and roots 20 of the airfoils is melted and removed from the mold wall section 24 when the mold wall section is hardened by firing at a relatively high temperature. The resulting annular mold wall section 24 with the airfoils 14 projecting radially inwardly from their associated recesses 26 can then be connected with the upper and lower mold sections 38 and 30 in the manner previously explained.

Figure 4:
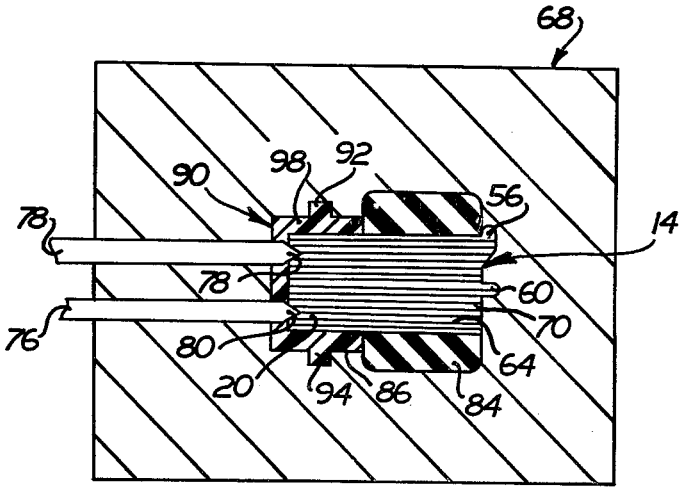
FIG. 4 is a sectional view illustrating the manner in which a metal airfoil is held in a die cavity while wax is injected around a root end portion of the metal airfoil.

In order to provide for the forming of the wax covering over the root portion 20 of the airfoil 14, the airfoil is positioned in a die 68 (see FIG. 4). The metal die 68 has a cavity 70 with an upwardly extending portion in which the hook portion 56 of the airfoil 14 is received. Similarly, the die cavity 70 includes a rightwardly (as viewed in FIG. 4) projecting portion in which the nose portion 60 of the airfoil 14 is received. A pair of locating members 74 and 76 engage notches 78 and 80 formed in the root end portion 20 of the airfoil 14 to provide for accurate locating of the airfoil in the die cavity 70.

A rubber seat or seal 84 circumscribes and firmly grips the blade portion 64 of the airfoil 14 to seat a root portion 86 of the die cavity 70 from the portion of the die cavity in which the blade 64 is located. Hot wax under pressure is injected into the root portion 86 of the blade cavity 70. This hot wax forms a covering 90 over the root end portion 20 of the airfoil 14.

The wax covering 90 over the root of the airfoil 14 has a pair of accurately located cylindrical buttons 92 and 94 which extend outwardly from opposite sides of the airfoil 14. The wax projections or buttons 92 and 94 are accurately located relative to the airfoil 14 and are subsequently used to position the airfoil in the dipping fixture of FIG. 6. In addition to the locating buttons 92 and 94 (FIG. 4) the wax covering 90 includes a main section 98 which is of substantially uniform thickness and completely encloses the root 20 of the airfoil 14. It should be noted that the wax covering 90 can be formed from either a naturally occurring wax or from a synthetic polymeric material such as polystyrene and that as used herein the term wax is intended to cover both naturally occurring waxes and synthetic waxes of many different compositions.

After the wax covering 90 has solidified around the root end portion 20 of the airfoil 14, the airfoil is removed from the die 68. At this time only the root end portion 20 of the airfoil 14 is covered with wax and the metal surface of the blade 64 is exposed.

Figure 5:
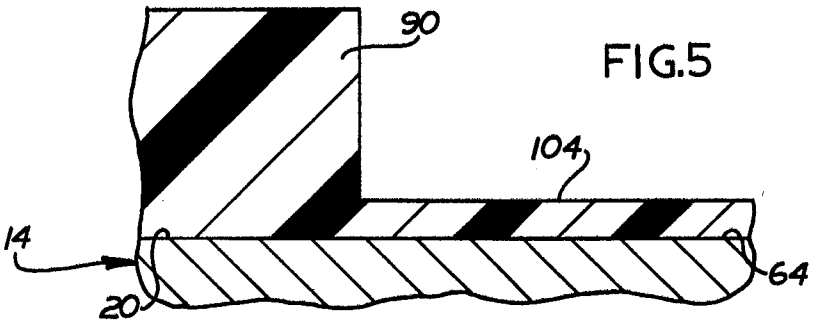
FIG. 5 is an enlarged fragmentary sectional view illustrating the relationship between the wax around the root portion of the airfoil in the die cavity of FIG. 4 and a relatively thin coating of wax which is subsequently applied to the blade portion of the airfoil.

In order to compensate for the thermal expansion of the blade 64 of the airfoil 14 in the mold recess 26 (FIG. 3), the blade 64 of the airfoil is covered with a thin coating of wax by dipping the blade into a body of hot liquid wax. This results in a relatively thin coating 104 (see FIG. 5) over the blade portion 64 of the airfoil 14. In one specific instance the thin wax coating 104 had a thickness of approximately 0.003 inches. The thin wax coating 104 extends up to and becomes integrally formed with the wax coating 90 which was applied to the root portion 20 of the airfoil 14 in the die 68 (see FIG. 4). Thus, after the blade portion 64 of the airfoil 14 has been dipped to form a thin coating 104, the airfoil 14 is almost completely covered with wax. After a plurality of the airfoils 14 have been covered with wax in the manner previously explained, the airfoils are mounted in a circular array in a dipping fixture 110 (see FIG. 6). The dipping fixture 110 is utilized to hold the airfoils 14 while they are dipped in a slurry of ceramic mold material to form a wet coating of ceramic mold material over the blade portion 64 of the airfoils. This ceramic coating is dried and fired to form the annular wall section 24 (see FIG. 2).

The dipping fixture 110 includes a pair of circular aluminum discs 112 and 114 which are separated by an aluminum spacer member 116 (see FIG. 6). The discs 112 and 114 are provided with cylindrical holes 120 and 122 which are disposed in circular arrays adjacent to the peripheral side surfaces of the discs. The holes 120 and 122 in the discs are accurately located to receive the wax buttons 92 and 94 formed in the bodies of wax 90 at the root end portion 20 of the airfoil 14. The holes are used to accurately position the airfoils 14 relative to each other. The bodies of wax 90 formed around the root end portion 20 of the airfoils are sized so that they are disposed in abutting engagement when the airfoils 14 are disposed in a circular array about the periphery of the discs 112 and 114.

Once the airfoils 14 have been mounted in a circular array about the periphery of the discs 112 and 114, a pair of annular wax bodies 126 and 128 are injection molded around the wax bodies 90 which enclose the root end portions 20 of the airfoils 14. The annular wax bodies 126 and 128 overlie end surface areas 130 and 132 of the discs 112 and 114.

In order to form the circular mold wall section 24 (see FIGS. 2 and 3), the dipping fixture 110 is dipped in a slurry of liquid ceramic mold material. Although many different types of slurries of ceramic mold material could be utilized, one illustrative slurry contains fused silica, zircon, and other refractory materials in combination with binders. Chemical binders such as ethyl silicate, sodium silicate and colloidal silica can be utilized. In addition, the slurry may contain suitable film formers such as alginates to control viscosity and wetting agents to control flow characteristics and pattern wettability.

In accordance with common practices, the initial slurry coating applied to the pattern contains a finely divided refractory material to produce an accurate surface finish. A typical slurry for a first coat may contain approximately 29% colloidal silica suspension in the form of a 20 to 30% concentrate. Fused silica of a particle size of 325 mesh or smaller in an amount of 71% can be employed together with less than 1–10% percent by weight of a wetting agent. Generally, the specific gravity of the slurry of ceramic mold material may be on the order of 1.75 to 1.80 and have a viscosity of 40 to 60 seconds when measured with a Number 5 Zahn cup at 75° to 85° F. After the application of the initial coating, the surface is stuccoed with refractory materials having particle sizes on the order of 60 to 200 mesh.

Between each of the dip coatings, annular surface areas 138 and 140 on the bodies of wax material 126 and 128 (see FIG. 6) are wiped to remove the wet ceramic mold material from these surfaces. This results in a pair of annular discontinuities in the wet ceramic coating overlying the mold fixture 110. The discontinuities separate the wet ceramic coating into three general areas, that is a central or main area overlying the airfoils 14 and a pair of circular end areas overlying the circular major side surfaces 142 and 144 of the aluminum discs 112 and 114. When the coating of ceramic mold material is subsequently dried, the portions of the coating overlying the side surfaces 142 and 144 of the aluminum discs 112 and 114 are discarded and the central portion overlying the airfoils 14 becomes the annular mold wall section 24.

After a coating of ceramic mold material of a desired thickness has been built up over the airfoils 14, the coating is dried and then fired at approximately 1900° F. for one hour to thoroughly cure the mold sections. It should be noted that at relatively low temperatures which occur during an initial portion of the firing, the wax surrounding the airfoils melts and is drained from the recesses 26 containing the blade portion 64 of the airfoils. This provides a space between the blade portion of the airfoils and the inner side surfaces of the recesses.

Once the ceramic coating overlying the airfoils 14 has been hardened by firing and the wax drained, the mold section 24 is ready to be connected with the upper and lower sections 38 and 30 of the mold assembly 22 (see FIG. 2). The manner in which the mold sections are interconnected is similar to that disclosed in U.S. Pat. No. 4,066,116 to William S. Blazek et al and entitled "Mold Assembly and Method of Making the Same." Accordingly, the manner in which these mold sections are interconnected will not be further described herein in order to avoid prolixity of description.

The forming of the article 10 is completed by pouring molten metal into the mold cavity 46. This molten metal flows around the root portion 20 of each of the airfoils 14 disposed in recesses 26 in the circular mold wall 24 to interconnect the airfoils. Once the molten metal in the mold cavity 46 has solidified to form the hub 12, the mold assembly 22 is broken away from the cast product and subjected to suitable finishing operations.

In view of the foregoing description it is apparent that the present invention provides a method of forming a metal article 10 having one or more airfoils 14 which are connected with a base or hub 12. When the method is to be used to cast an article having a plurality of airfoils 14 extending outwardly from a hub 12, blade portions 64 of separate metal airfoils 14 are covered with a thin coating 104 of wax. The airfoils 14 are then arranged in a circle and are covered with a wet coating of ceramic mold material. The ceramic mold material dries to form an annular mold wall section 24 having recesses 26 with configurations corresponding to the configurations of the airfoils 14. The wax coating 104 is then removed from the recesses 26 by firing the ceramic mold material. When they cool, this results in the formation of space between the airfoils 14 and the side walls of a mold recesses 26 in which the airfoils are disposed. The mold assembly 22 is then completed by connecting top and bottom mold wall sections 38 and 30 with the annular mold wall section 24 containing the airfoils 14.

Prior to pouring of molten metal into the mold assembly 22, the mold assembly is preheated to a relatively high temperature. As the mold assembly 22 and the metal airfoils 14 are heated, the airfoils 14 expand to a greater extent than the ceramic mold material overlying the airfoils. Due to their higher coefficient of expansion, the metal airfoils 14 completely fill the recesses 26 in which they are disposed when the mold assembly has been preheated prior to casting. Although the present invention is advantageously used to cast an article 10 having a plurality of airfoils 14 extending outwardly from a hub 12, it is contemplated that features of the invention will be used in making other types of articles.

Having described one specific preferred embodiment of the invention, the following is claimed:

1. A method of forming a metal article having a plurality of airfoils extending outwardly from a hub, said method comprising the steps of forming a mold having a cavity with a configuration corresponding to the configuration of the article and having a portion which receives a plurality of metal airfoils, said step of forming a mold including forming the portion of the mold which receives the plurality of metal airfoils by performing the steps of providing a plurality of metal airfoils each of which has a root portion and a blade portion, placing the metal airfoils in a circular array, covering the root portion of each of the airfoils with wax, said step of covering the root portion of the airfoils with wax including the step of forming wax locating surfaces which are accurately positioned relative to the blade portions of the airfoils, said step of placing the metal airfoils in a circular array including the step of accurately positioning the metal airfoils relative to each other by engaging the wax locating surfaces, covering the circular array of metal airfoils with a wet coating of liquid ceramic mold material, holding the metal airfoils against movement relative to each other during said step of covering the circular array of airfoils with a wet coating of ceramic mold material by engaging the wax locating surfaces formed on the wax coverings over the root portions of the metal airfoils, and drying the wet coating of ceramic mold material to form a circular wall with a circular array of recesses which extend outwardly from the center of the circular wall, each of the recesses containing at least the blade portion of one of the airfoils and having a configuration corresponding to the configuration of the blade portion of the metal airfoil in the recess, and pouring molten metal into the mold cavity with the blade portions of the airfoils in the recesses to form a hub interconnecting the circular array of metal airfoils.

2. A method as set forth in claim 1 wherein said step of covering the circular array of metal airfoils with a wet coating includes the step of dipping the circular array of metal airfoils in a body of liquid ceramic material.

3. A method as set forth in claim 1 further including the step of heating each of the metal airfoils from a first temperature to a second temperature prior to performing said step of pouring molten metal and after performing said step of drying the wet coating of liquid ceramic mold material, each of metal airfoils being smaller than the recess in which it is disposed when the metal airfoils are at the first temperature, said step of heating the metal airfoils from the first temperature to the second temperature including the step of effecting the thermal expansion of the airfoils to at least substantially fill the recesses in which they are disposed.

4. A method of forming a metal article having a plurality of airfoils extending outwardly from a hub, said method comprising the steps of forming a mold having a plurality of sections defining a cavity with a configuration corresponding to the configuration of the article at least one of the sections having a portion which receives a plurality of metal airfoils, said step of forming a mold including forming the portion of the mold which receives the plurality of metal airfoils by performing the steps of providing a plurality of metal airfoils each of which has a root end portion and a blade end portion, placing the metal airfoils in a circular array, holding axially opposite sides of the circular array of metal airfoils between a pair of circular support members which overlie the root end portions of the metal airfoils with the blade end portions of the metal airfoils projecting outwardly from the support members, covering the circular array of metal airfoils with a wet coating of liquid ceramic mold material, said step of covering the circular array of metal airfoils with a wet coating of liquid ceramic mold material includes the step of at least partially covering the support members and blade end portions of the airfoils with a wet coating of liquid ceramic mold material, forming a first circular discontinuity in the wet coating of ceramic mold material over the first support member and forming a second circular discontinuity in the wet coating of ceramic mold material over the second support member to separate the portion of the wet coating of ceramic mold material over the blade end portions of the airfoils from portions of the wet coating over the support members, drying the wet coating of ceramic mold material to form a circular wall with a circular array of recesses which extend outwardly from the center of the circular wall, each of the recesses containing at least the blade end portion of one of the airfoils and having a configuration corresponding to the configuration of the blade end portion of the metal airfoil in the recess, moving the circular support members away from the circular array of metal airfoils, and further forming the mold by connecting additional sections to the circular wall, and pouring molten metal into the mold cavity with the airfoils in the recesses to form a hub interconnecting the circular array of metal airfoils.

5. A method as set forth in claim 4 wherein said step of covering the circular array of metal airfoils with a coating of liquid ceramic mold material is performed with the metal airfoils at a first temperature, said method further including the steps of heating each of the metal airfoils to a temperature which is greater than the first temperature prior to performing said step of pouring molten metal, said step of heating each of the metal airfoils being performed with each of the metal airfoils in one of the recesses and including the step of allowing thermal expansion of the metal airfoils, said method further including the steps of at least partially coating each of the metal airfoils with a layer of material before performing said step of at least partially covering the circular array of metal airfoils with a wet coating of liquid ceramic mold material and removing the layer of material from each of the metal airfoils before performing said step of heating the metal airfoils to thereby provide space in each of the recesses to accept thermal expansion of the airfoils during said heating step.

6. A method as set forth in claim 4 wherein each of the recesses has an end surface and each of the metal airfoils has a tip end portion and a root end portion, each of the tip end portions of the metal airfoils being disposed in abutting engagement with the end surface of a recess and each of the root end portions of the metal airfoils being exposed during said step of pouring molten metal.

7. A method of forming a metal article having a plurality of airfoils extending outwardly from a hub, said method comprising the steps of forming a mold having a cavity with a configuration corresponding to the configuration of the article and having a portion which receives a plurality of metal airfoils, said step of forming a mold including forming the portion of the mold which receives the plurality of metal airfoils by performing the steps of providing a plurality of metal airfoils, coating each of the metal airfoils with a layer of a first material, placing the metal airfoils in a circular array, covering the circular array of metal airfoils with a wet coating of liquid ceramic mold material while the metal airfoils are at a first temperature, said step of covering the circular array of metal airfoils with ceramic mold material including the step of applying a wet coating of ceramic mold material over the layer of a first material, drying the wet coating of ceramic mold material to form a circular wall with a circular array of recesses which extend outwardly from the center of the circular wall, each of the recesses containing one of the metal airfoils and having a configuration corresponding to the configuration of the metal airfoil in the recess, and removing the layer of a first material from each of the metal airfoils to provide a space in each of the recesses between an outer surface area of a metal airfoil and the ceramic mold material, heating each of the metal airfoils to a temperature which is greater than the first temperature after having performed said step of removing the layer of a first material, said step of heating each of the metal airfoils being performed with each of the metal airfoils in one of the recesses and including the step of effecting thermal expansion of the metal airfoils to at least substantially fill the recesses in which they are disposed, and pouring molten metal into the mold cavity with the airfoils in the recesses after performing said step of heating each of the metal airfoils to form a hub interconnecting the circular array of metal airfoils.

8. A method as set forth in claim 7 wherein each of the metal airfoils has a root end portion and a blade end portion, said method further including the step of holding axially opposite sides of the circular array of metal airfoils between a pair of circular support members which overlie the root end portions of the metal airfoils with the blade end portions of the metal airfoils projecting outwardly from the support members, said step of covering the circular array of metal airfoils with a wet coating of liquid ceramic mold material includes the step of covering the support members and blade portions of the airfoils with a wet coating of liquid ceramic mold material, said step of forming a mold further including the steps of forming a first circular discontinuity in the wet coating ceramic mold material over the first support member and forming a second circular discontinuity in the wet coating of ceramic mold material over the second support member to separate the portion of the wet coating of ceramic mold material over the blade portions of the airfoils from portions of the wet coating over the support members, and moving the circular support members away from the circular array of metal airfoils.

9. A method as set forth in claim 7 wherein each of the airfoils has a root portion and a blade portion, said step of coating each of the airfoils with a first material includes covering the root portion of each of the airfoils with the first material, said step of covering the root portion of the airfoils with the first material includes the step of forming locating surfaces which are accurately positioned relative to the blade portions of the airfoils and are formed of the first material, said step of placing the metal airfoils in a circular array including the step of accurately positioning the metal airfoils relative to each other by engaging the locating surfaces, said step of forming a mold further including holding the metal airfoils against movement relative to each other during said step of covering the circular array of airfoils with a wet coating of ceramic mold material by engaging the locating surfaces formed on the coverings over the root portions of the metal airfoils.

10. A method as set forth in claim 7 further including the step of retaining the airfoils in the recesses after performing the step of removing the layer of a first material from each of the airfoils, said step of retaining the airfoils in the recesses including the step of engaging the dried coating of ceramic mold material with projections formed on the airfoils.

11. A method of forming a metal article having a plurality of airfoils extending outwardly from a hub, said method comprising the steps of forming a mold having a cavity with a configuration corresponding to the configuration of the article and having a portion which receives a plurality of metal airfoils, said step of forming a mold including forming the portion of the mold which receives the plurality of metal airfoils by performing the steps of providing a plurality of metal airfoils having blade portions and root portions, placing the metal airfoils in an array, applying a wet coating of ceramic mold material over the blade portions of the airfoils and drying the wet coating of ceramic mold material to form a wall with an array of recesses, each of said airfoil receiving recesses being slightly larger than the blade portion of the airfoil received therein, providing for tight engagement between the airfoils and inner surfaces of the recesses by heating the airfoils in the recesses to effect thermal expansion of the airfoils, and pouring molten metal into the mold cavity with the airfoils thermally expanded into tight engagement with the inner surfaces of the recesses to form a hub interconnecting the airfoils.

12. A method as set forth in claim 11 wherein said step of forming a mold includes the step of covering the blade portions of the airfoils with wax to provide wax pattern surface areas which are larger than and have configurations corresponding to the configurations of the blade portions of the airfoils, said step of applying a wet coating of ceramic mold material includes covering the wax pattern surface areas with a wet coating of ceramic mold material, said method of forming a mold further including removing the wax to provide recesses having inner surface areas which are larger than and have configurations corresponding to the configurations of the blade portions of the airfoils.

* * * * *